US012721402B2

(12) United States Patent
Tateno et al.

(10) Patent No.: US 12,721,402 B2
(45) Date of Patent: Sep. 1, 2026

(54) SOLE AND FOOTWEAR

(71) Applicant: ASICS CORPORATION, Kobe (JP)

(72) Inventors: Kenta Tateno, Kobe (JP); Yoshihiro Eguchi, Kobe (JP)

(73) Assignee: ASICS CORPORATION, Kobe (JP)

( * ) Notice: Subject to any disclaimer, the term of this patent is extended or adjusted under 35 U.S.C. 154(b) by 91 days.

(21) Appl. No.: 17/916,514

(22) PCT Filed: Apr. 13, 2020

(86) PCT No.: PCT/JP2020/016307
§ 371 (c)(1),
(2) Date: Sep. 30, 2022

(87) PCT Pub. No.: WO2021/210045
PCT Pub. Date: Oct. 21, 2021

(65) Prior Publication Data

US 2024/0225181 A1 Jul. 11, 2024

(51) Int. Cl.
*A43B 13/18* (2006.01)
*A43B 7/142* (2022.01)
*A43B 13/14* (2006.01)

(52) U.S. Cl.
CPC ..... *A43B 13/186* (2013.01); *A43B 7/142* (2013.01); *A43B 13/145* (2013.01); *A43B 13/185* (2013.01)

(58) Field of Classification Search
CPC ... A43B 13/186; A43B 13/145; A43B 13/185; A43B 13/12; A43B 13/125; A43B 13/127; A43B 7/142
See application file for complete search history.

(56) References Cited

U.S. PATENT DOCUMENTS 6,038,790 A * 3/2000 Pyle ..... A43B 7/144 36/28
7,096,605 B1 * 8/2006 Kozo ..... A43B 7/26 36/76 R (Continued)

FOREIGN PATENT DOCUMENTS

EP 0890322 A1 * 1/1999 ..... A43B 13/143
EP 1025770 A2 2/2000

(Continued)

OTHER PUBLICATIONS

International Search Report issued in corresponding International Application No. PCT/JP2020/016307 on Jul. 14, 2020.

(Continued)

*Primary Examiner* — Patrick J. Lynch
*Assistant Examiner* — Brianna T. Duckworth
(74) *Attorney, Agent, or Firm* — Spencer Fane, LLP

(57) ABSTRACT

A sole includes an outer sole, a midsole, and a plate. The plate includes a toe section and a midfoot section. The toe section includes a fore edge part having a shape convex-curved forward in a longitudinal direction, a recessed edge part having a shape extending rearward in the longitudinal direction from a lateral end of the fore edge part in a width direction while extending toward a lateral side in the width direction and convex-curved toward a medial side in the width direction, and a lateral edge part having a shape extending rearward in the longitudinal direction from a lateral end of the recessed edge part in the width direction and convex-curved toward the lateral side in the width direction.

10 Claims, 15 Drawing Sheets

(56) References Cited

U.S. PATENT DOCUMENTS

| | | | | |
|---|---|---|---|---|
| 2016/0029741 | A1* | 2/2016 | Foxen | A43B 13/187 36/103 |
| 2016/0316853 | A1 | 11/2016 | Iuchi et al. | |
| 2017/0095034 | A1* | 4/2017 | Dupre | A43B 13/141 |
| 2017/0245590 | A1* | 8/2017 | Kohatsu | A43B 13/188 |
| 2019/0365030 | A1* | 12/2019 | Chambers | A43B 13/14 |
| 2020/0093219 | A1 | 3/2020 | Iuchi et al. | |
| 2020/0100565 | A1* | 4/2020 | Yoshida | A43B 13/026 |

FOREIGN PATENT DOCUMENTS

| | | | |
|---|---|---|---|
| JP | 59008570 | Y | 3/1984 |
| JP | H0431503 | U | 3/1992 |
| JP | H04036803 | | 3/1992 |
| JP | 2015529136 | A | 10/2015 |
| JP | 2015208504 | A | 11/2015 |
| JP | 2018534028 | A | 11/2018 |
| JP | 2020048686 | A | 4/2020 |
| WO | 2009106075 | A1 | 9/2009 |
| WO | 2014046915 | A1 | 3/2014 |
| WO | 2017058417 | A1 | 4/2017 |

OTHER PUBLICATIONS

Supplemental European Search Report issued in corresponding European Application No. 20931243 on Mar. 15, 2023.
Summons to Attend Oral Proceedings issued in corresponding European Application No. 20931243.8 on May 16, 2024.

* cited by examiner

SOLE AND FOOTWEAR

CROSS-REFERENCE TO RELATED APPLICATION

This application is a U.S. National Stage of International Application No. PCT/JP2020/016307, filed Apr. 13, 2020, the content of which is hereby incorporated by reference.

FIELD OF THE INVENTION

This disclosure relates to a sole and footwear.

BACKGROUND INFORMATION

Soles for footwear are required to have various functions in accordance with the use thereof. For example, soles of conventional running shoes are each required to have a shock-absorbing property for cushioning an impact upon landing, rigidity of a midfoot portion (a portion located at a center in a longitudinal direction of footwear) for preventing a corresponding foot from being twisted during running, flexibility upon take-off, and the like.

Japanese Patent Publication No. 2018-534028 discloses footwear including a plate for making the rigidity of the midfoot portion. The plate includes a toe section corresponding to toes of the foot, an MP section corresponding to MP joints, and a bridge section corresponding to an arch of the foot. The plate is formed in a concave shape with a constant radius of curvature.

SUMMARY

It has been determined that a sole including a plate to assist natural takeoff and transmit the force of the toes to the ground more efficiently upon take-off is desired.

It is therefore an object of the present disclosure to provide a sole and footwear capable of achieving both natural takeoff assist and transmission of the force of the toes to the ground more efficiently upon take-off.

A sole according to one aspect of the present disclosure is part of footwear, the sole including an outer sole, a midsole disposed on the outer sole, and a plate disposed at the midsole, the plate being higher in rigidity than the midsole, the plate includes a toe section disposed at a position overlapping a toe portion of a wearer in a thickness direction of the sole, and a midfoot section has a shape that extends rearward from the toe section in a longitudinal direction of the footwear, the midfoot section being disposed at a position overlapping, in the thickness direction, a midfoot portion located at a center of a foot of the wearer in the longitudinal direction, and the toe section includes a fore edge part disposed at a position overlapping, in the thickness direction, a first distal phalanx and a second distal phalanx of the wearer or at a position located forward of the position in the longitudinal direction and having a shape that is convex-curved forward in the longitudinal direction, a recessed edge part having a shape that extends rearward in the longitudinal direction while extending from a lateral end of the fore edge part in a width direction of the footwear toward a lateral side in the width direction and is convex-curved toward a medial side in the width direction, and a lateral edge part having a shape that extends rearward in the longitudinal direction from a lateral end of the recessed edge part in the width direction and is convex-curved toward the lateral side in the width direction.

Further, footwear according to one aspect of this disclosure includes the sole and an upper portion connected to the sole and located on the sole.

According to this disclosure, a sole and a footwear capable of achieving both natural takeoff assistance and transmission of a force of the toes to the ground more efficiently upon take-off are provided.

BRIEF DESCRIPTION OF DRAWINGS

The invention will be explained in more detail hereinafter with reference to the drawings.

DETAILED DESCRIPTION

Figure 1:
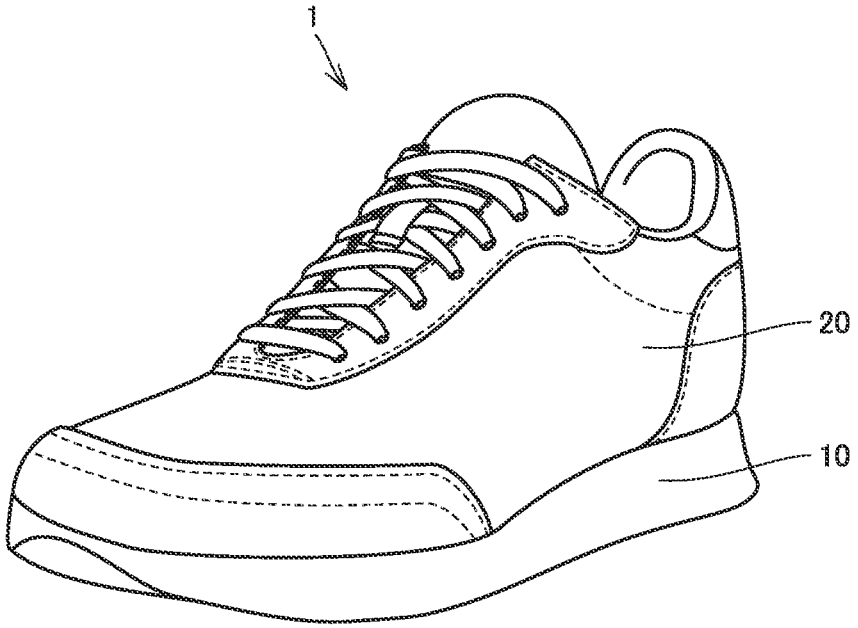
FIG. 1 is a schematic perspective view of footwear according to a first embodiment of the present disclosure.

Embodiments of this disclosure will be described with reference to the drawings. Note that, in the drawings to be referenced below, the same or corresponding members are denoted by the same reference numerals. In the following description, terms such as longitudinal direction, width direction, fore, and rear are used. Such directional terms indicate directions viewed from the viewpoint of a wearer wearing footwear 1 placed on a flat surface such as the ground. For example, "fore" refers to a toe side, and "rear" refers to a heel side. Further, a medial foot side refers to a medial side of the foot (first toe side of the foot) in the width direction, and a lateral foot side refers to a lateral side of the foot in the width direction.

First Embodiment

Figure 2:
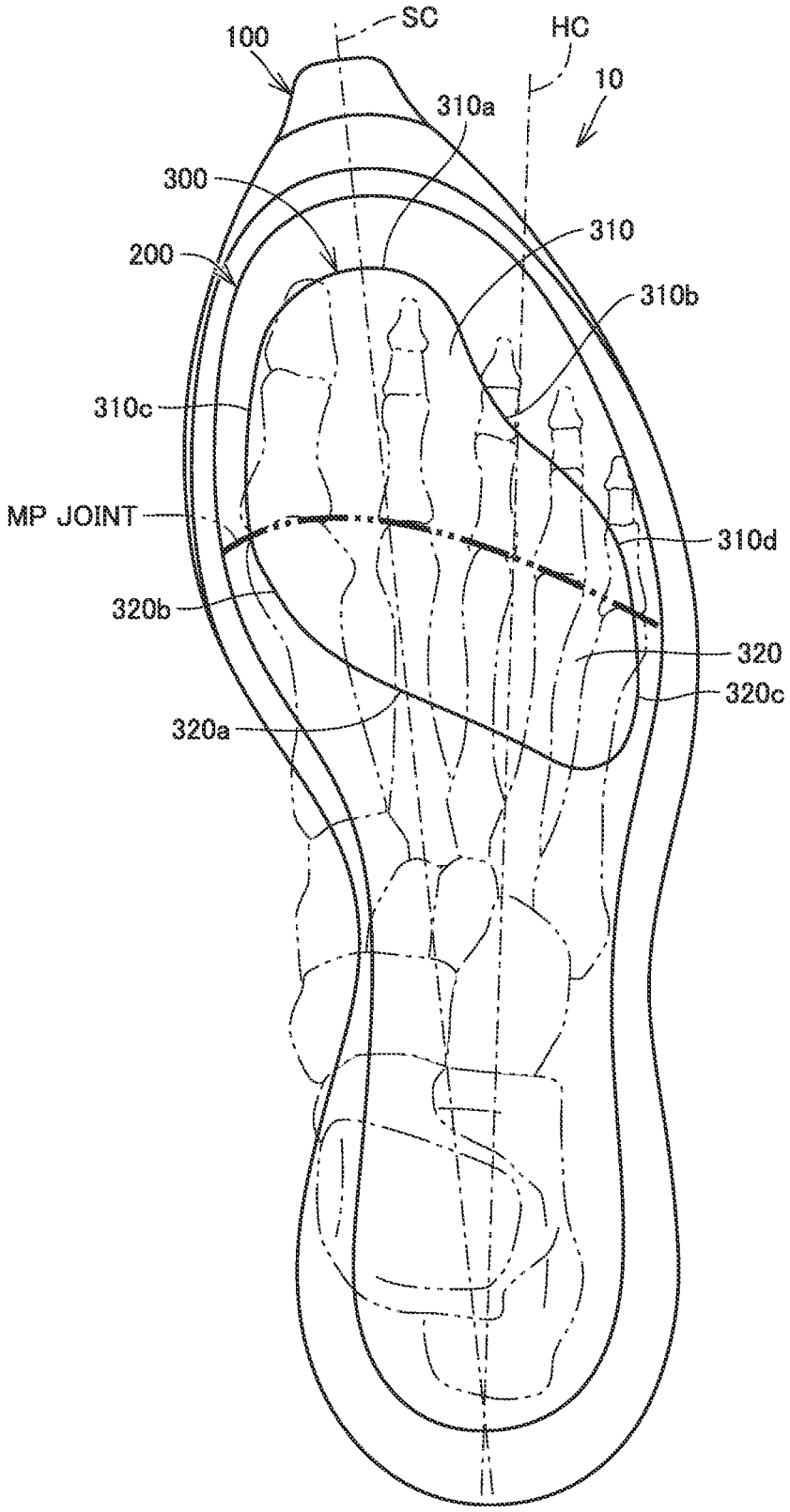
FIG. 2 is a plan view of a sole.
Figure 3:
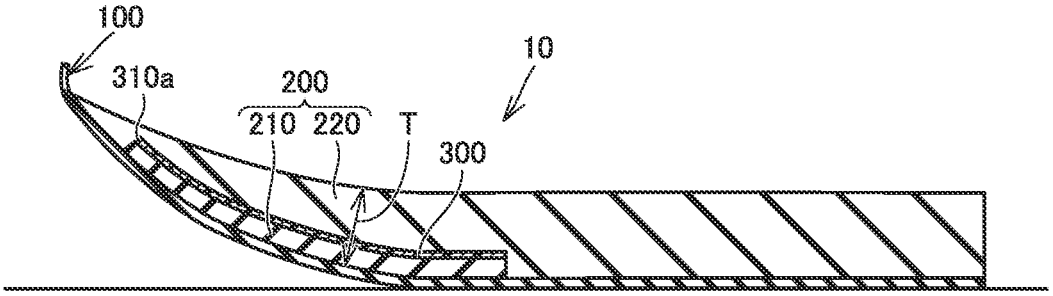
FIG. 3 is a cross-sectional view of the sole.

FIG. 1 is a schematic perspective view of footwear according to a first embodiment of the present disclosure, FIG. 2 is a plan view of a sole, and FIG. 3 is a cross-sectional view of the sole. Note that FIGS. 2 and 3 illustrate a sole 10 for the right foot, but this sole 10 is also applicable to the left foot, and in this case, the sole 10 for the left foot and the sole 10 for the right foot are symmetrical. Footwear 1 according to the present embodiment is particularly suitable for running shoes, for example, but is also applicable to other athletic shoes or walking shoes, and there is no limitation on the use of the footwear.

As illustrated in FIG. 1, the footwear 1 includes the sole 10 and an upper portion 20. The upper 20 is connected to the sole 10 to form a space for accommodating a foot with the sole 10. As illustrated in FIGS. 2 and 3, the sole 10 includes an outer sole 100, a midsole 200, and a plate 300. The outer sole 100 constitutes a tread portion. The outer sole 100 is formed from rubber or the like. The midsole 200 is disposed on the outer sole 100, and the upper portion 20 is disposed on the midsole 200. That is, the midsole 200 is disposed between the upper 20 and the outer sole 100.

The midsole 200 is formed from, for example, a resin foam material containing a resin material as a main component and a foaming agent and a cross-linking agent as accessory components. As the resin material, a thermoplastic resin and a thermosetting resin can be used. As the thermoplastic resin, for example, an ethylene-vinyl acetate copolymer (EVA) can be suitably used. As the thermosetting resin, for example, polyurethane (PU) can be suitably used. Alternatively, the midsole 200 can be formed from a rubber foam material containing a rubber material as a main component and a plasticizer, a foaming agent, a reinforcing agent, and a cross-linking agent as accessory components. As the rubber material, for example, a butadiene rubber can be suitably used. Note that the material of the midsole 200 is not limited to the above-described materials, and the midsole 200 can be formed of a resin or rubber material having an appropriate strength and excellent shock-absorbing property.

The plate 300 is provided at the midsole 200. The plate 300 is higher in rigidity than the midsole 200, and is made of a fiber-reinforced resin or a non-fiber-reinforced resin. Examples of the fiber used for the fiber-reinforced resin include a carbon fiber, a glass fiber, an aramid fiber, a Dyneema™ fiber, a Zylon™ fiber, and a boron fiber. Examples of the non-fiber-reinforced resin include a polymer resin such as a polyurethane-based thermoplastic elastomer (TPU) and an amide-based thermoplastic elastomer (TPA).

As illustrated in FIG. 3, in the present embodiment, the plate 300 is disposed in the midsole 200. Specifically, the midsole 200 includes a lower midsole 210 disposed between the plate 300 and the outer sole 100, and an upper midsole 220 disposed on the plate 300. The lower midsole 210 is preferably lower in rigidity than the upper midsole 220. Note that although the plate 300 is disposed in the midsole 200, the plate 300 is represented by a solid line in FIG. 2 for easy recognition of the plate 300.

A ratio of a thickness of the plate 300 to a thickness T (see FIG. 3) of the midsole 200 is preferably greater than or equal to 5% and less than or equal to 30%, and more preferably greater than or equal to 7.5% and less than or equal to 12.5%. A position where the ratio is measured is an area immediately below the MP joints of the wearer of the footwear 1 or near the area, and more specifically, an area immediately below a thenar or near the area. Setting the thickness T of the plate 300 to be greater than or equal to 7.5% makes the rigidity of the plate 300 high, so that the effect of the plate 300 can be effectively obtained. Setting the thickness T of the plate 300 to be less than or equal to 12.5% makes the plate 300 lightweight and further makes the plate 300 deformable to a sufficient degree, so that a force of the toes is effectively transmitted to the ground.

As illustrated in FIG. 3, the plate 300 is curved so as to gradually extend upward while extending forward in the longitudinal direction of the footwear 1. The curvature of the plate 300 preferably varies so as to decrease stepwise from the rear toward the fore in the longitudinal direction. This causes a repulsive force of the plate 300 to change stepwise. Alternatively, the curvature of the plate 300 can be set to be medium, large, or small from the rear to the fore in the longitudinal direction. This makes the tread portion flat and thus enables a force from the foot to be stably transmitted to the ground.

In the present embodiment, the plate 300 includes a toe section 310 and a midfoot section 320. As illustrated in FIG. 2, the toe section 310 is disposed at a position overlapping a toe portion of the wearer in the thickness direction of the sole 10. That is, the toe section 310 is a portion overlapping toes located forward of the MP joints of the foot of the wearer. The toe section 310 includes a fore edge part 310*a*, a recessed edge part 310*b*, a medial edge part 310*c*, and a lateral edge part 310*d*.

The fore edge part 310*a* is disposed at a position overlapping a first distal phalanx and a second distal phalanx of the wearer in the thickness direction, or at a position located forward of the position in the longitudinal direction. The fore edge part 310*a* has a shape that is convex-curved forward in the longitudinal direction. More specifically, the fore edge part 310*a* has a shape that is convex-curved forward along a center line SC (see FIG. 2) of the footwear 1. Note that the center line SC is not limited to the center line of the footwear 1, and can be a line corresponding to a straight line connecting a center of a calcaneus of a typical wearer of the footwear 1, and a gap between the first toe and the second toe.

The recessed edge part 310*b* has a shape that extends rearward in the longitudinal direction while extending from a lateral end of the fore edge part 310*a* in the width direction of footwear 1 toward the lateral side in the width direction and is convex-curved toward the medial side in the width direction. More specifically, the recessed edge part 310*b* has a shape that intersects a heel center HC (see FIG. 2) that is a straight line passing through a center of a heel of the wearer and convex-curved toward the medial side in the width direction. Note that the heel center HC means a straight line connecting the center of the calcaneus of the typical wearer of the footwear 1, and a gap between the third toe and the fourth toe. The recessed edge part 310*b* is larger in radius of curvature than the fore edge part 310*a*.

The medial edge part 310*c* has a shape that extends rearward in the longitudinal direction from a medial end of the fore edge part 310*a* in the width direction and is convex-curved toward the medial side in the width direction.

The lateral edge part 310*d* has a shape that extends rearward in the longitudinal direction from a lateral end of the recessed edge part 310*b* in the width direction and is convex-curved toward the lateral side in the width direction. The lateral edge part 310*d* is approximately equal in radius of curvature to the recessed edge part 310*b*.

The midfoot section 320 is disposed at a position overlapping, in the thickness direction, a midfoot portion located at a center of the foot of the wearer in the longitudinal direction. The midfoot section 320 has a shape that extends rearward in the longitudinal direction from the toe section 310. That is, the midfoot section 320 is a portion that overlaps, in the thickness direction, a portion located rearward of the MP joints of the foot of the wearer. The midfoot section 320 includes a rear edge part 320*a*, a medial connecting edge part 320*b*, and a lateral connecting edge part 320*c*.

The rear edge part 320*a* is formed at a rear end of the midfoot section 320 in the longitudinal direction. The rear edge part 320*a* is disposed at a position overlapping a center portion of a first metatarsal, a center portion of the second metatarsal, a center portion of a third metatarsal, a center portion of a fourth metatarsal, and a center portion of a fifth metatarsal of the wearer in the thickness direction. The rear edge part 320*a* has a shape that gradually extends rearward in the longitudinal direction while extending toward the lateral side in the width direction.

The medial connecting edge part 320*b* connects a medial end of the rear edge part 320*a* in the width direction and the medial edge part 310*c*. The medial connecting edge part 320*b* has a shape that is convex-curved toward the medial side in the width direction.

The lateral connecting edge part 320*c* connects a lateral end of the rear edge part 320*a* in the width direction and the lateral edge part 310*d*. The lateral connecting edge part 320*c* has a shape that is convex-curved toward the lateral side in the width direction.

As described above, in the sole 10 according to the present embodiment, the fore edge part 310*a* of the toe section 310 corresponding to a portion overlapping the toes located forward of the MP joints of the wearer is disposed at a position overlapping the first distal phalanx and the second distal phalanx or at a position located forward of the position, so that a first proximal phalanx and a second proximal phalanx are effectively supported by the toe section 310, and a load upon landing is appropriately guided in a first toe direction.

Furthermore, on the lateral side of the fore edge part 310*a* in the width direction, the recessed edge part 310*b* has a shape that extends rearward in the longitudinal direction while extending toward the lateral side in the width direction and convex-curved toward the medial side in the width direction is formed, so that a fourth middle phalanx and a fifth middle phalanx are prevented from overlapping the toe section 310. This configuration prevents movement of each joint of the third toe to the fifth toe of the wearer upon take-off from being restricted by the plate 300. This in turn allows natural takeoff and the force of the toes to be effectively transmitted to the ground upon take-off.

Second Embodiment

Figure 4:
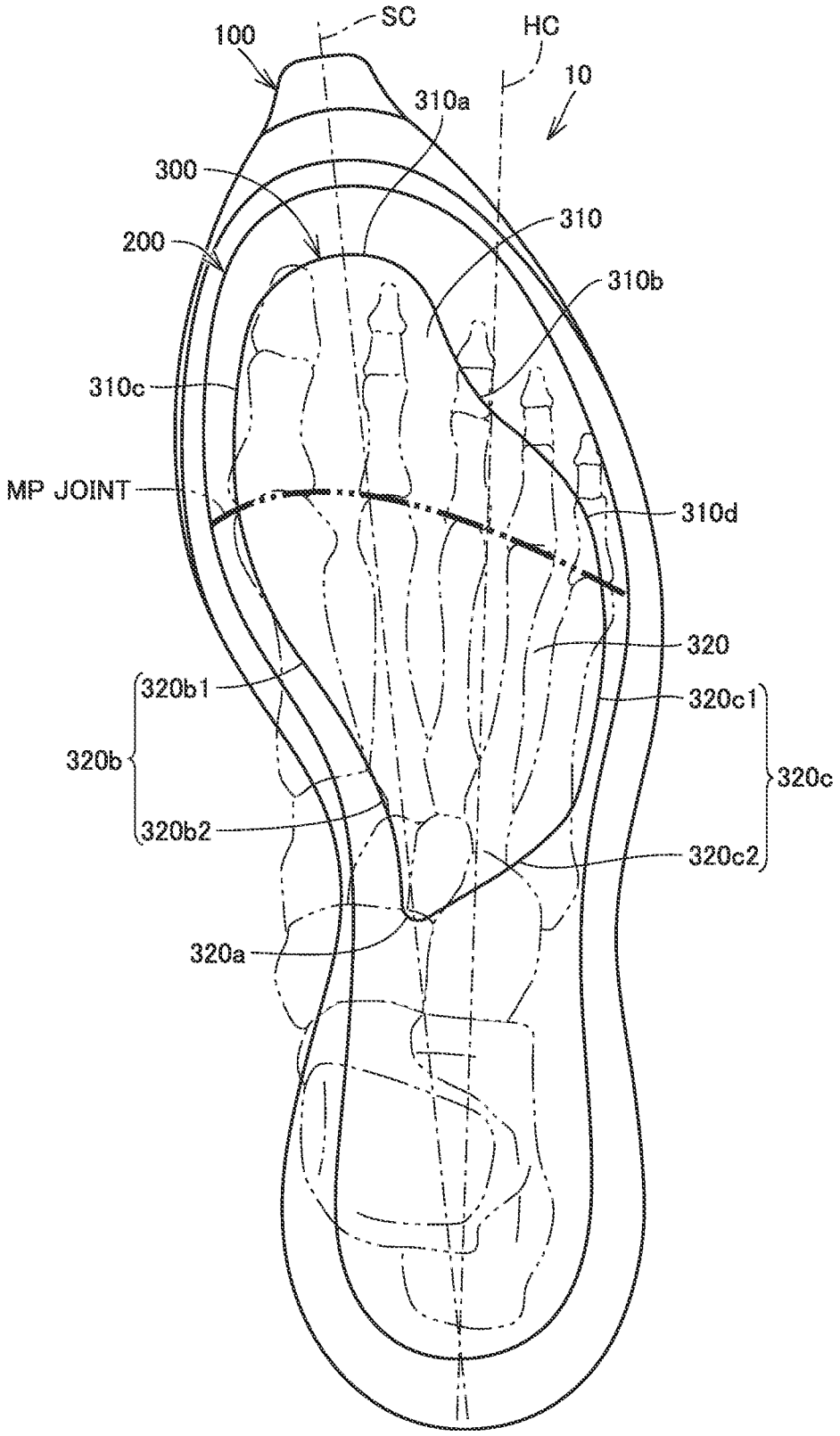
FIG. 4 is a plan view of a sole of footwear according to a second embodiment of the present disclosure.

Next, a plate 300 according to a second embodiment of the present disclosure will be described with reference to FIG. 4. In the second embodiment, only parts different from those of the first embodiment will be described, and the description of the same structure, operation, and effect as those of the first embodiment will not be repeated.

The present embodiment is different in the shape of the midfoot section 320 of the plate 300 from the first embodiment. Specifically, the rear edge part 320*a* is disposed at a position overlapping a third cuneiform bone of the wearer in the thickness direction or at a position rearward of the position in the longitudinal direction. The rear edge part 320*a* has a shape that is convex-curved rearward in the longitudinal direction.

The medial connecting edge part 320*b* includes a first medial connecting edge part 320*b*1 and a second medial connecting edge part 320*b*2. The first medial connecting edge part 320*b*1 has a shape that extends rearward in the longitudinal direction from a rear end of the medial edge part 310*c* and is convex-curved toward the medial side in the width direction.

The second medial connecting edge part 320*b*2 has a shape that connects the rear end of the medial edge part 310*c* in the longitudinal direction and the rear edge part 320*a* and is convex-curved toward the lateral side in the width direction.

The lateral connecting edge part 320*c* includes a first lateral connecting edge part 320*c*1 and a second lateral connecting edge part 320*c*2. The first lateral connecting edge part 320*c*1 has a shape that extends rearward in the longitudinal direction from a rear end of the lateral edge part 310*d* in the longitudinal direction and is convex-curved toward the lateral side in the width direction. The second lateral connecting edge part 320*c*2 connects a rear end of the first lateral connecting edge part 320*c*1 in the longitudinal direction and the rear edge part 320*a*. The second lateral connecting edge part 320*c*2 has a shape that gradually extends toward the medial side in the width direction while extending rearward in the longitudinal direction. The second lateral connecting edge part 320*c*2 can be formed in a linear shape or can be formed in a shape that is convex-curved rearward in the longitudinal direction.

A boundary between the first lateral connecting edge part 320*c*1 and the second lateral connecting edge part 320*c*2 has a shape that is convex-curved toward the lateral side in the width direction. The boundary is smaller in radius of curvature than the first lateral connecting edge part 320*cl*. The boundary is larger in radius of curvature than the rear edge part 320*a*.

Third Embodiment

Figure 5:
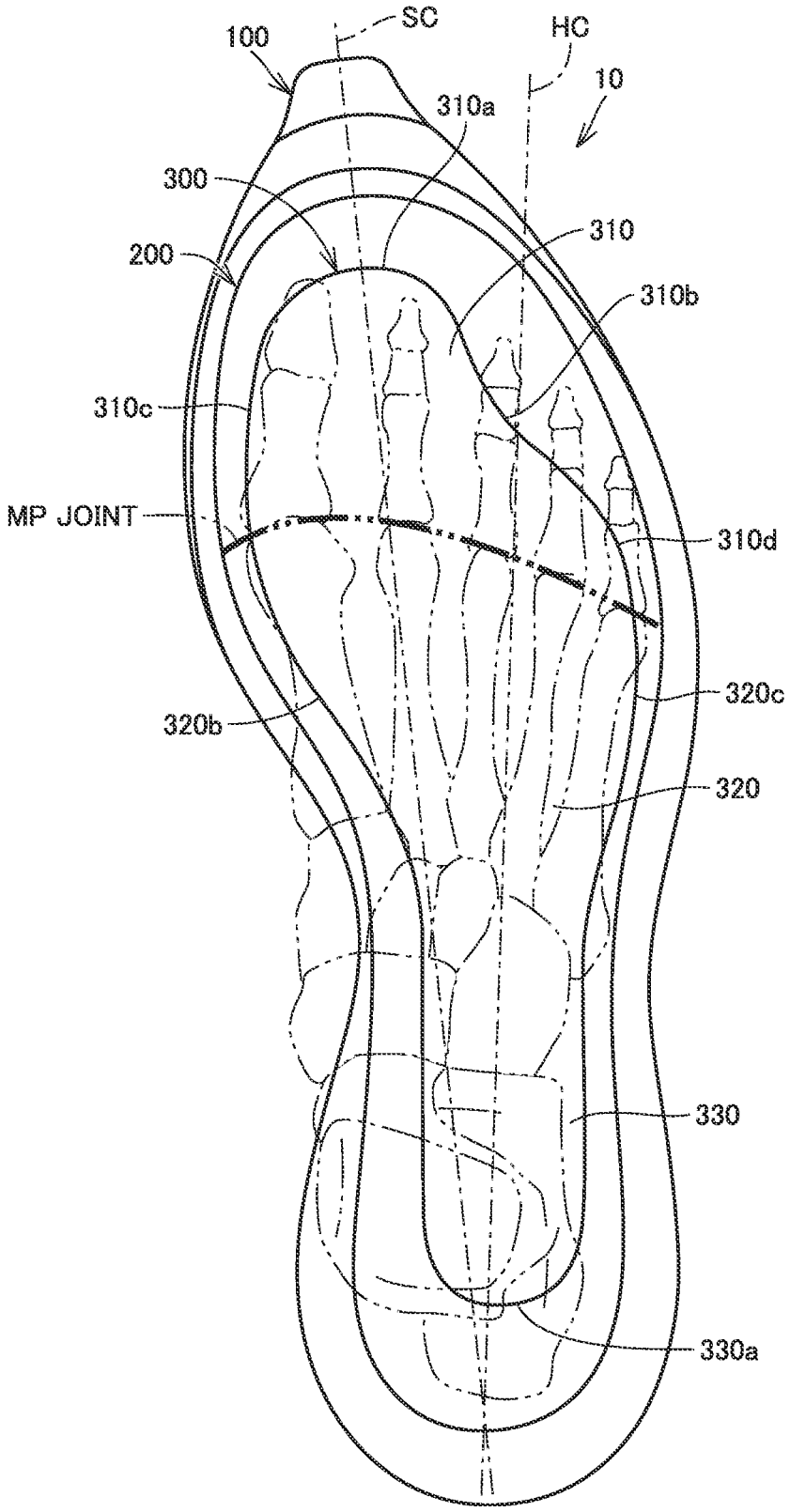
FIG. 5 is a plan view of a sole of footwear according to a third embodiment of the present disclosure.

Next, a plate 300 according to a third embodiment of the present disclosure will be described with reference to FIG. 5. In the third embodiment, only parts different from those of the first embodiment will be described, and the description of the same structure, operation, and effect as those of the first embodiment will not be repeated.

In the present embodiment, the plate 300 further includes a rearfoot section 330. The rearfoot section 330 is disposed at a position overlapping, in the thickness direction, a rearfoot portion located at a rear of the foot of the wearer in the longitudinal direction. The rearfoot section 330 has a shape that extends rearward in the longitudinal direction from the midfoot section 320.

The rearfoot section 330 includes a rear edge part 330*a* formed at a rear end of the rearfoot section 330 in the longitudinal direction. The rear edge part 330*a* is disposed at a position overlapping a talus and calcaneus of the wearer in the thickness direction. The rear edge part 330*a* has a shape that is convex-curved rearward in the longitudinal direction. The rear edge part 330*a* is smaller in radius of curvature than the recessed edge part 310*b*.

Fourth Embodiment

Figure 6:
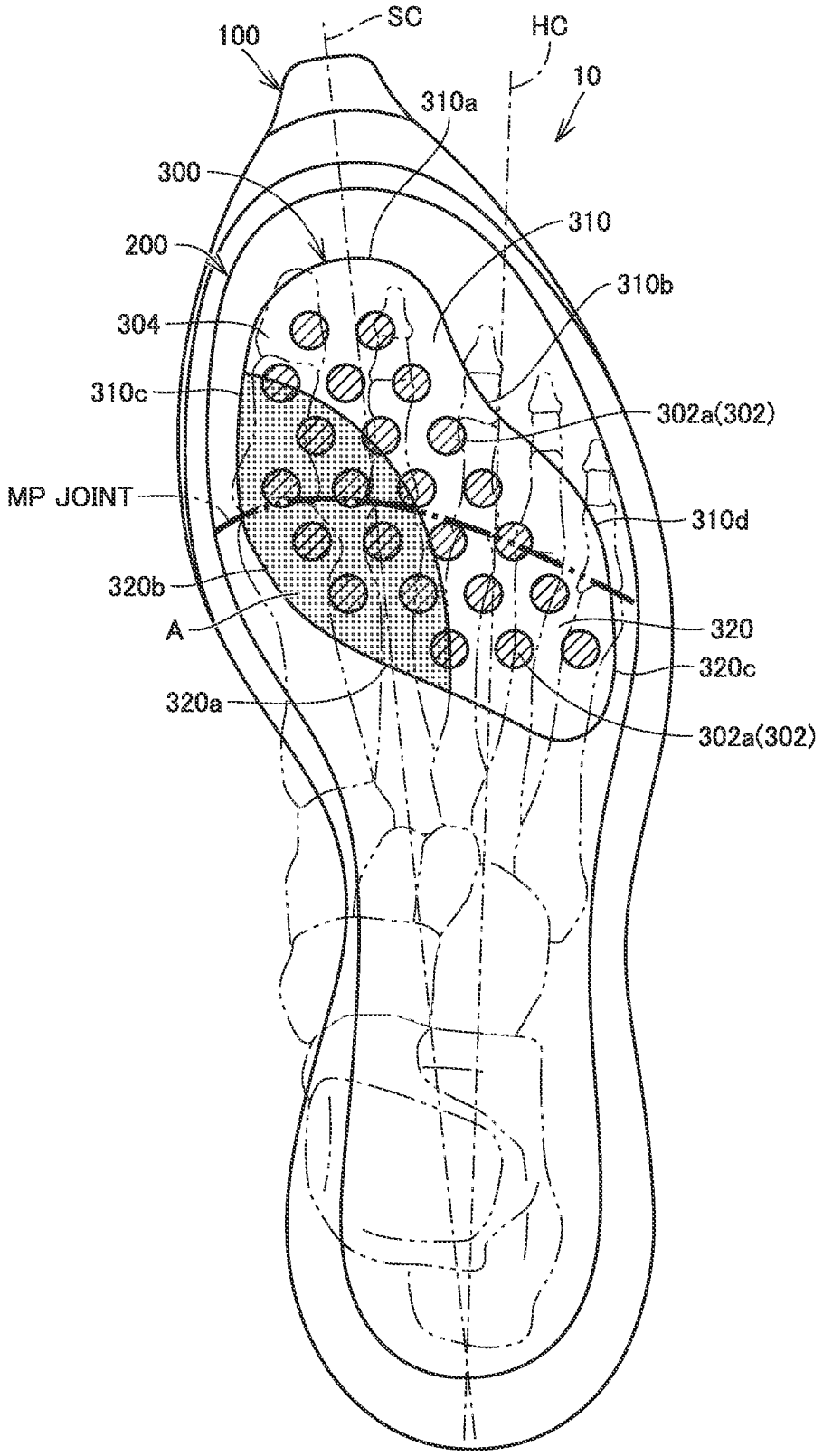
FIG. 6 is a plan view of a sole of footwear according to a fourth embodiment of the present disclosure.

Next, a plate 300 according to a fourth embodiment of the present disclosure will be described with reference to FIG. 6. In the fourth embodiment, only parts different from those of the first embodiment will be described, and the description of the same structure, operation, and effect as those of the first embodiment will not be repeated.

In the present embodiment, the plate 300 includes a low rigidity part 302 and a high rigidity part 304. Note that, in FIG. 6, the low rigidity part 302 is hatched in order to easily distinguish the low rigidity part 302 from the high rigidity part 304.

The low rigidity part 302 includes a plurality of low rigidity elements 302*a* formed in the toe section 310 and the midfoot section 320. The plurality of low rigidity elements 302*a* are formed at positions spaced apart from each other. Each low rigidity element 302*a* is preferably disposed at a position overlapping none of the MP joints of the wearer in the thickness direction.

As can be understood, the low rigidity part can be a configuration where each low rigidity element 302*a* is a through hole passing through the plate 300 in the thickness direction, a configuration where each low rigidity element 302*a* is thinner than the high rigidity part 304, or a configuration where each low rigidity element 302*a* is formed of a material lower in rigidity than the high rigidity part 304. In the embodiment where each low rigidity element 302*a* is thinner than the high rigidity part 304, each low rigidity element 302*a* can gradually decrease in thickness from a boundary between the low rigidity element 302*a* and the high rigidity part 304. In the embodiment where the low rigidity elements 302*a* are formed of a material different from the material of the high rigidity part 304, the low rigidity elements 302*a* and the high rigidity part 304 are, for example, bonded together or integrally-molded. Since the high rigidity part 304 is higher in rigidity than the low rigidity part 302, it will be understood that the high rigidity part 304 can formed of a portion of the plate 300 other than the low rigidity part 302. This aspect achieves both effective support of the foot of the wearer and enhancement of movement of the toes of the wearer.

Note that the low rigidity elements 302*a* need not necessarily be provided in a hatched region A in FIG. 16.

Fifth Embodiment

Figure 7:
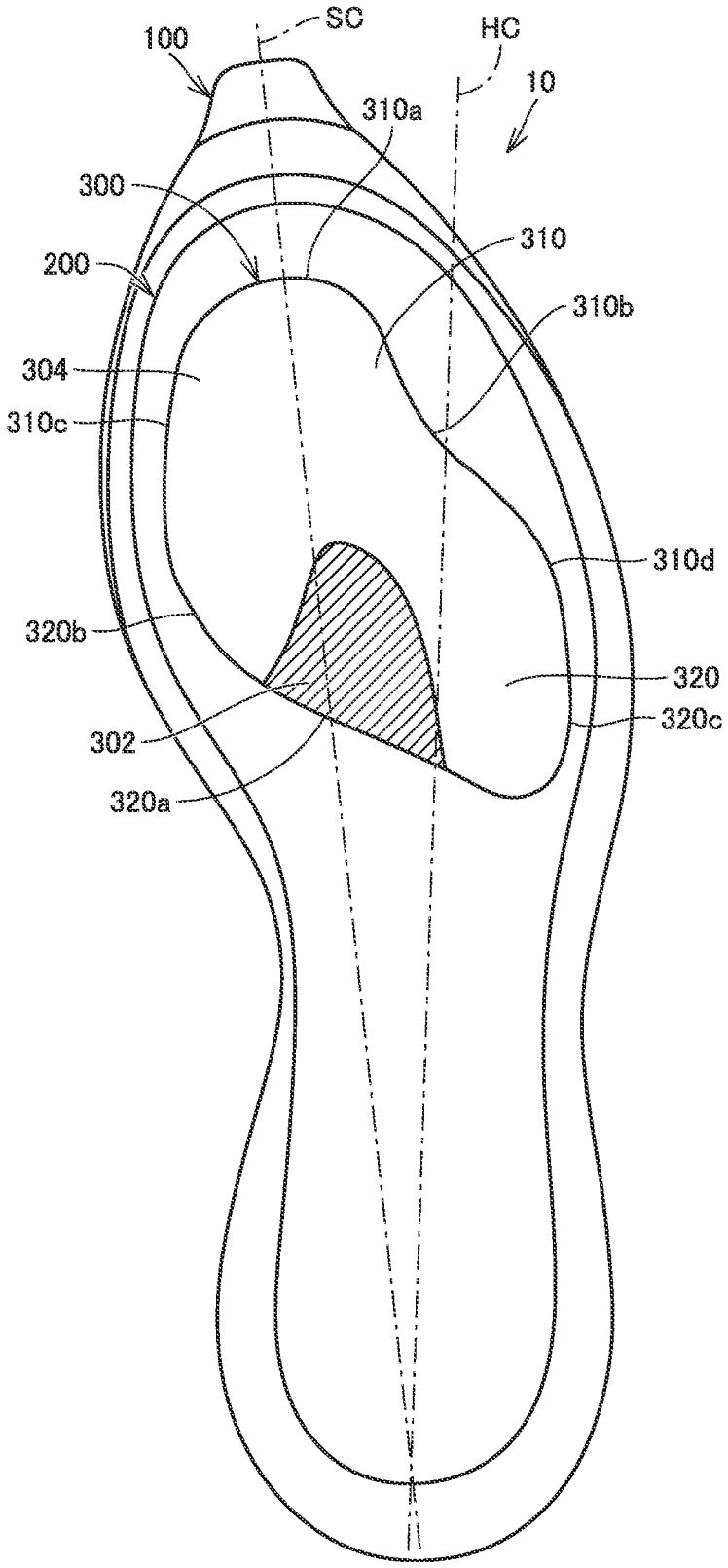
FIG. 7 is a plan view of a sole of footwear according to a fifth embodiment of the present disclosure.

Next, a plate 300 according to a fifth embodiment of the present disclosure will be described with reference to FIG. 7. In the fifth embodiment, only parts different from those of the fourth embodiment will be described, and the description of the same structure, operation, and effect as those of the fourth embodiment will not be repeated.

In the present embodiment, the low rigidity part 302 is disposed at a position overlapping, in the thickness direction, the third metatarsal of the wearer in the midfoot section 320. A rear edge of the low rigidity part 302 in the longitudinal direction constitutes a part of the rear edge part 320*a*.

Figure 8:
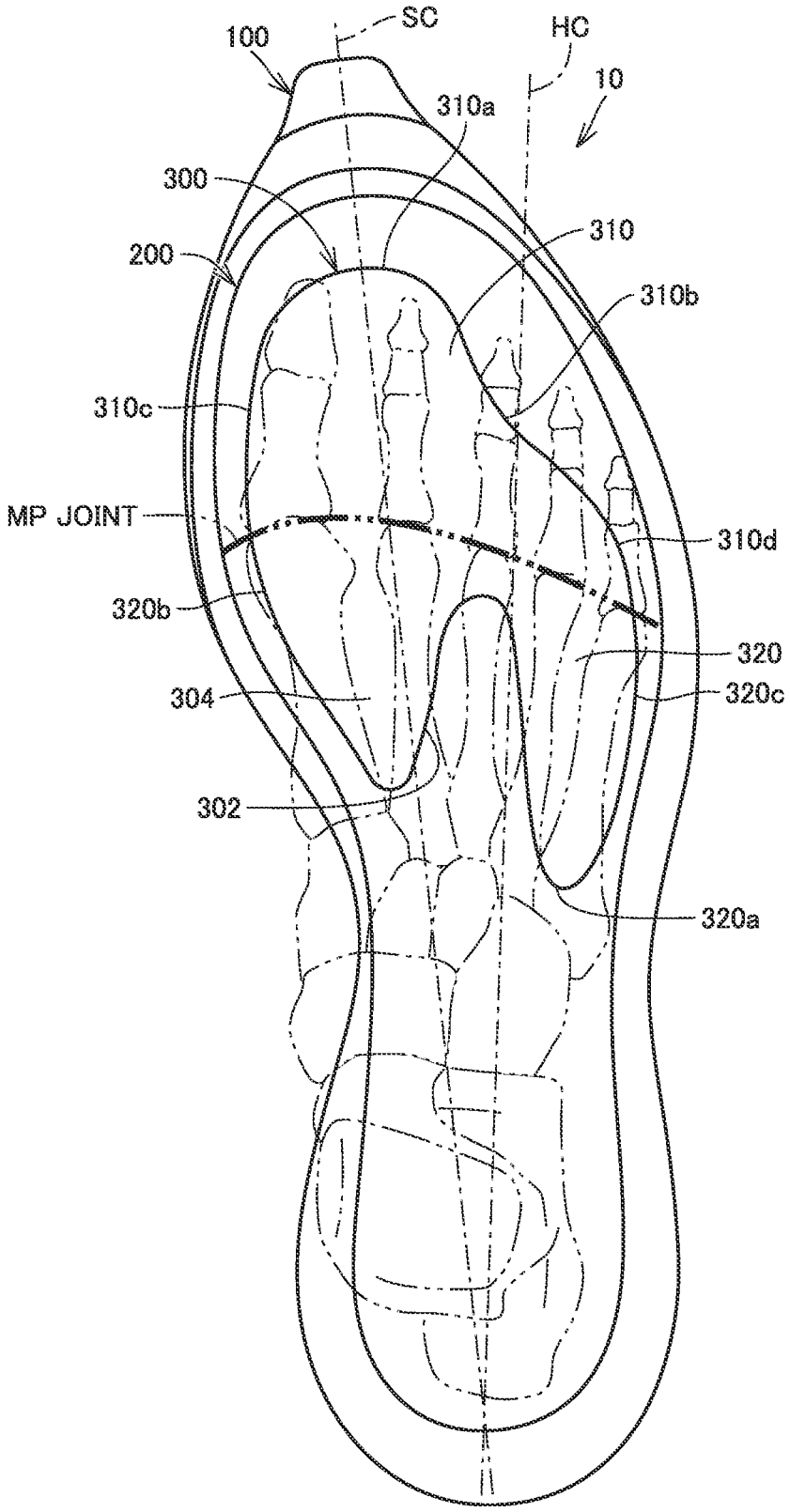
FIG. 8 is a plan view of a modification of the sole illustrated in FIG. 7.

In this embodiment, in a case where the low rigidity part 302 is a through hole, as illustrated in FIG. 8, portions of the high rigidity part 304 adjacent to both sides of the low rigidity part 302 in the width direction are preferably extended rearward in the longitudinal direction.

Sixth Embodiment

Figure 9:
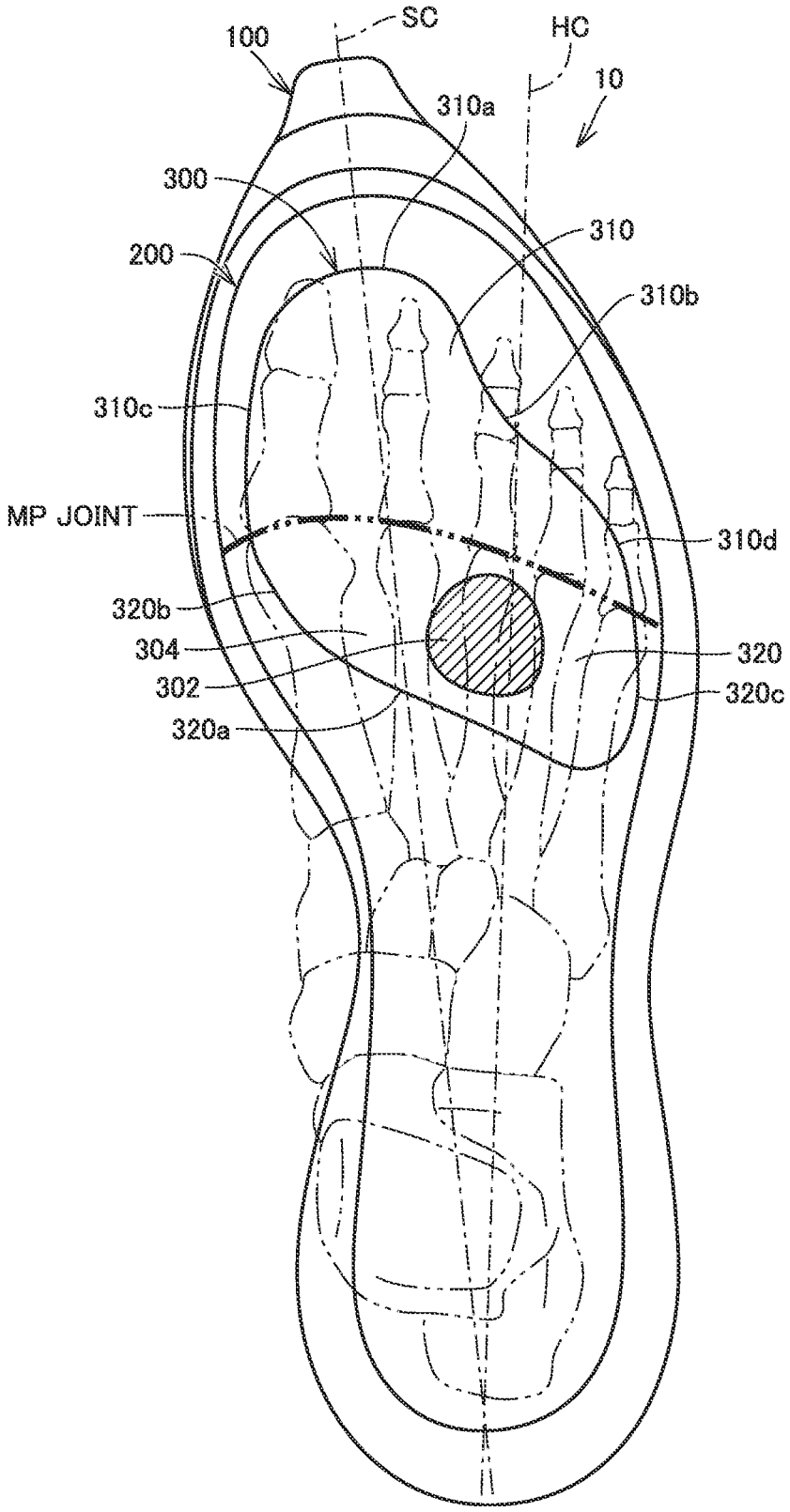
FIG. 9 is a plan view of a sole of footwear according to a sixth embodiment of the present disclosure.

Next, a plate 300 according to a sixth embodiment of the present disclosure will be described with reference to FIG. 9. In the sixth embodiment, only parts different from those of the fourth embodiment will be described, and the description of the same structure, operation, and effect as those of the fourth embodiment will not be repeated.

In the present embodiment, the low rigidity part 302 is disposed at a position overlapping, in the thickness direction, the third metatarsal of the wearer in the midfoot section 320, and the high rigidity part 304 has a shape that surrounds the entire perimeter of the low rigidity part 302.

Figure 10:
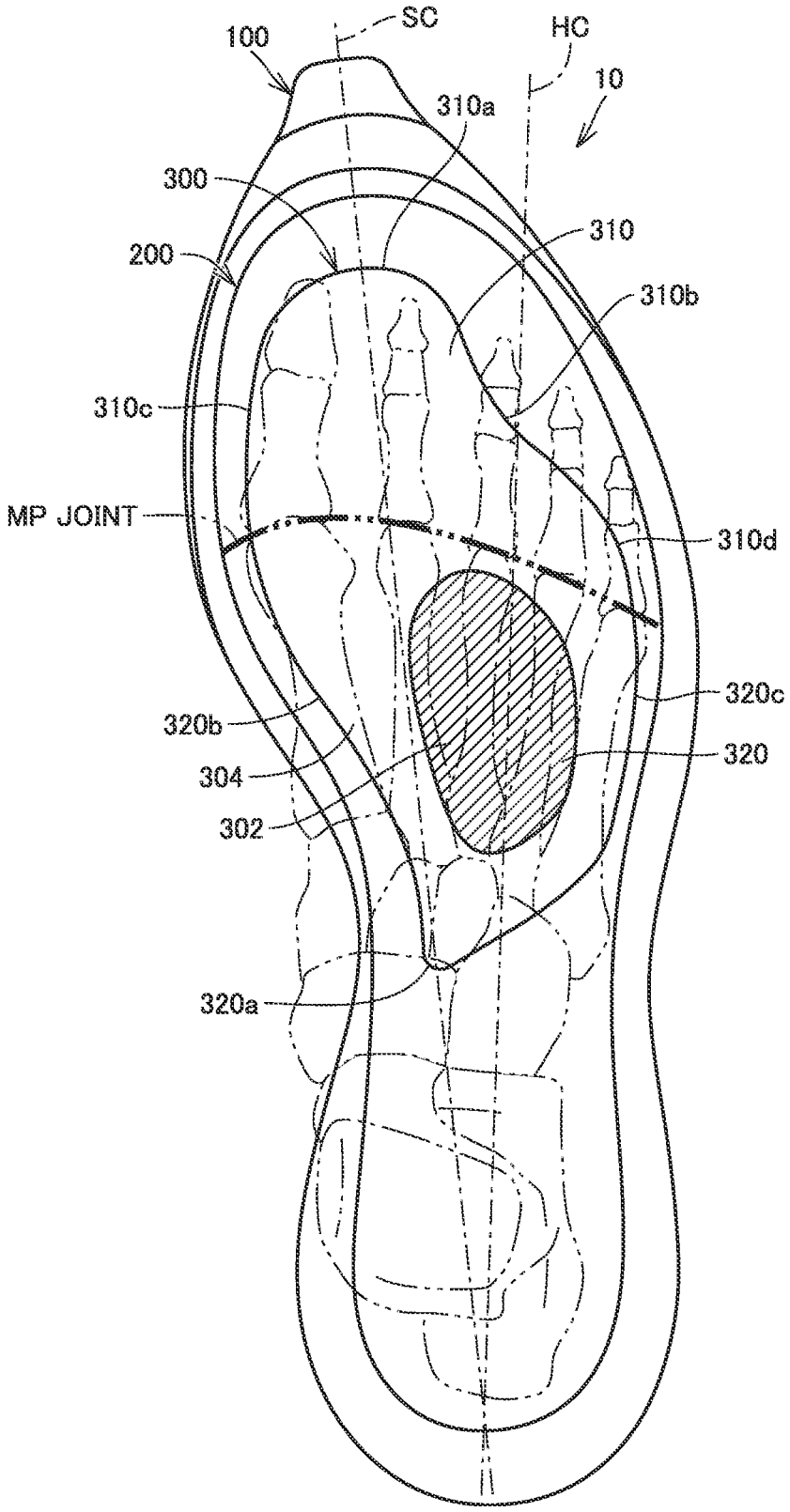
FIG. 10 is a plan view of a modification of the sole illustrated in FIG. 9.

In this embodiment, in the embodiment where the plate 300 is identical in outer shape to the plate 300 of the second embodiment, as illustrated in FIG. 10, the low rigidity part 302 preferably has a shape that approximately overlaps all the third metatarsal of the wearer in the thickness direction.

Seventh Embodiment

Figure 11:
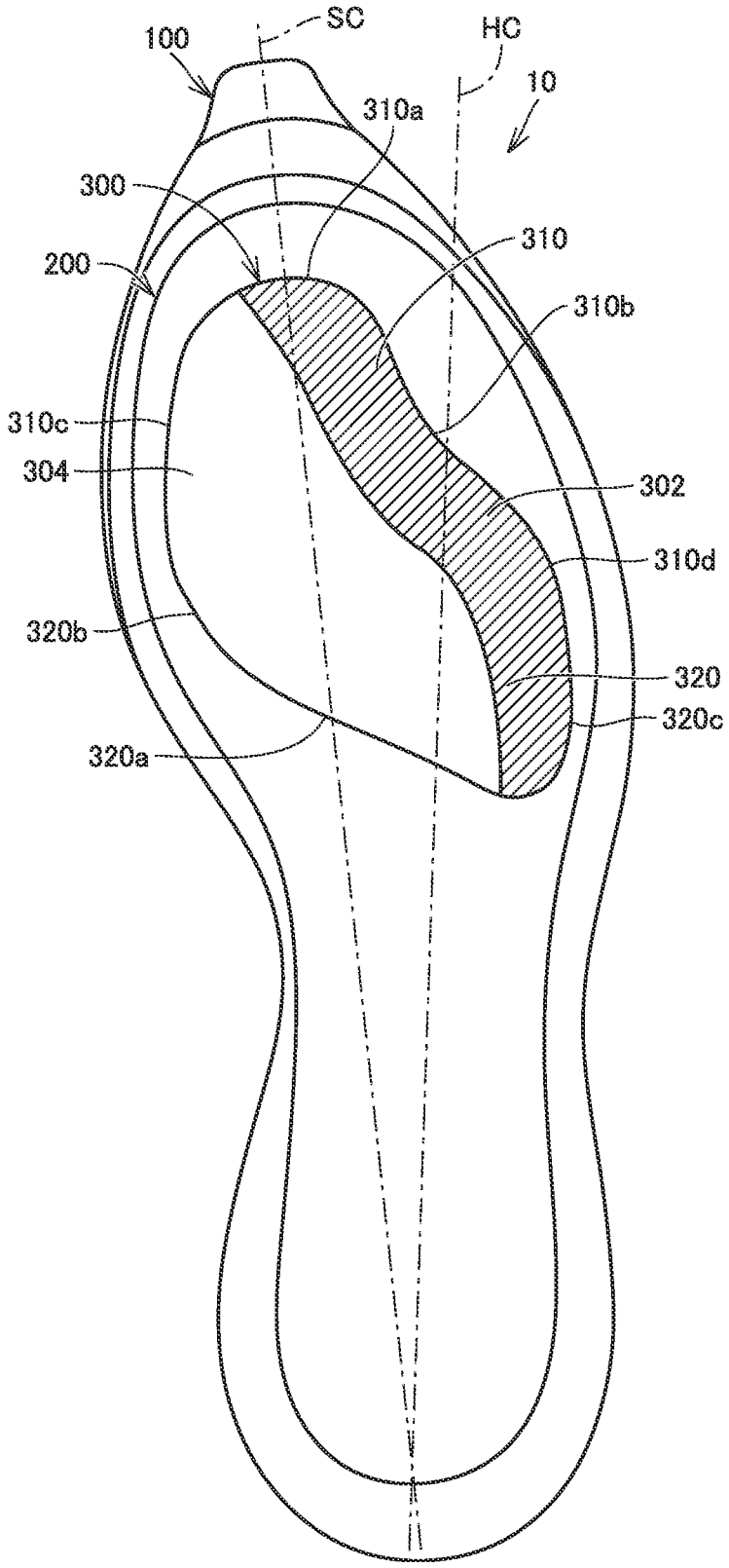
FIG. 11 is a plan view of a sole of footwear according to a seventh embodiment of the present disclosure.

Next, a plate 300 according to a seventh embodiment of the present disclosure will be described with reference to FIG. 11. In the seventh embodiment, only parts different from those of the fourth embodiment will be described, and the description of the same structure, operation, and effect as those of the fourth embodiment will not be repeated.

In the present embodiment, the low rigidity part 302 has a shape that includes a lateral edge of the plate 300 in the width direction and extends in the longitudinal direction, and the high rigidity part 304 has a shape that includes a medial edge of the plate 300 in the width direction and extends in the longitudinal direction. In the present embodiment, the low rigidity part 302 is thinner than the high rigidity part 304, or the low rigidity part 302 is formed of a material lower in rigidity than the high rigidity part 304.

This aspect prevents, with higher reliability, the movement of each joint of the third toe to the fifth toe of the wearer from being restricted by the plate 300.

It should be understood that the embodiments disclosed herein are illustrative in all respects and not restrictive. The scope of the present invention is defined by the claims rather than the above description, and the present invention is intended to include the claims, equivalents of the claims, and all modifications within the scope.

Figure 12:
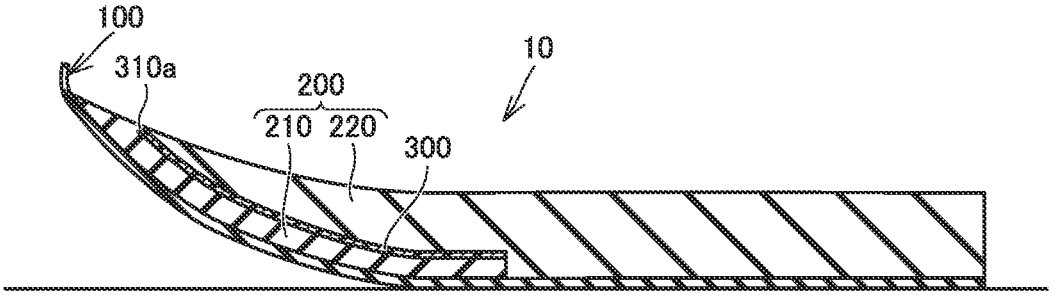
FIG. 12 is a cross-sectional view illustrating a modification of the disposition of the plate.

For example, in each of the above-described embodiments, as illustrated in FIG. 12, the fore edge part 310*a* can be disposed on a surface of the upper midsole 220. In this embodiment, transition from landing to takeoff is accelerated.

Figure 13:
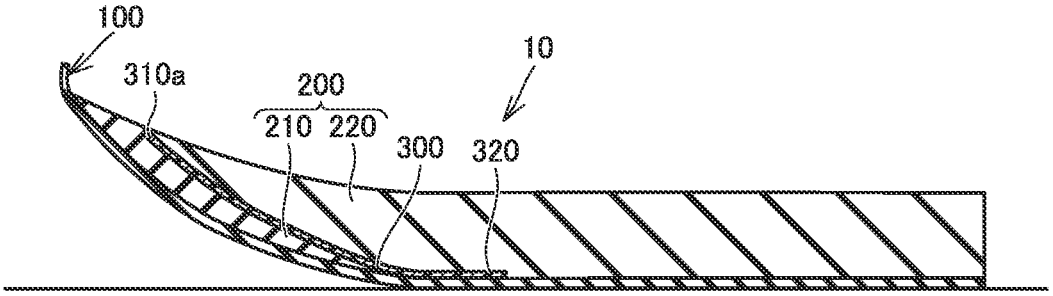
FIG. 13 is a cross-sectional view illustrating a modification of the disposition of the plate.

Alternatively, as illustrated in FIG. 13, the fore edge part 310*a* can be disposed on the surface of the upper midsole 220, and the rear of the midfoot section 320 in the longitudinal direction can be disposed so as to be in contact with an upper surface of the outer sole 100. At this time, the plate 300 is preferably smaller in radius of curvature than the outer sole 100. In this embodiment, the transition from landing to takeoff is accelerated.

Figure 14:
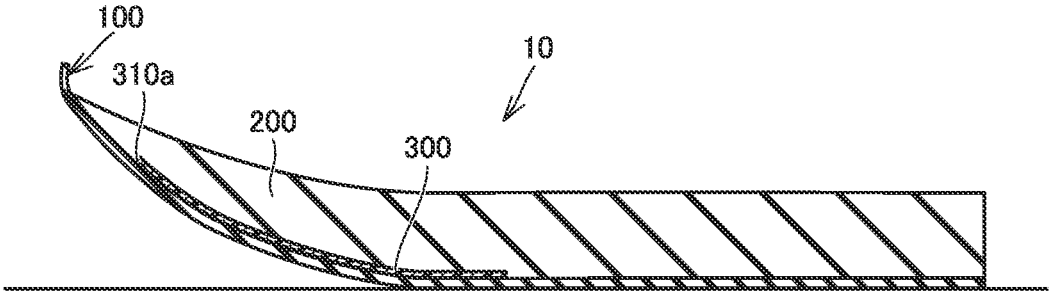
FIG. 14 is a cross-sectional view illustrating a modification of the disposition of the plate.

Alternatively, as illustrated in FIG. 14, the plate 300 can be disposed entirely in contact with a back surface of the midsole 200. In this embodiment, an impact applied to the forefoot portion is cushioned.

Figure 15:
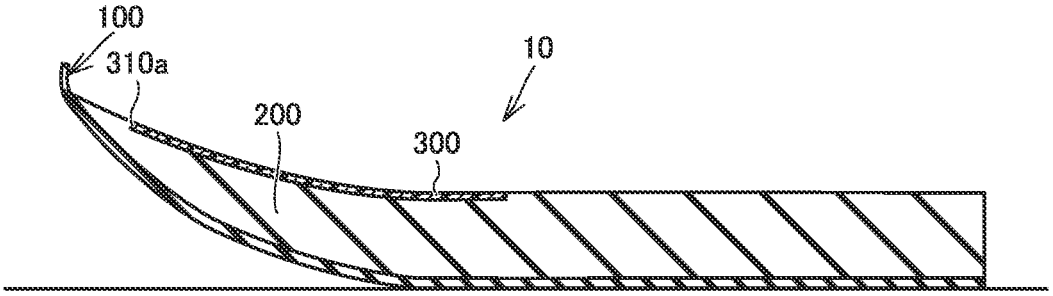
FIG. 15 is a cross-sectional view illustrating a modification of the disposition of the plate.

Alternatively, as illustrated in FIG. 15, the plate 300 can be disposed on a surface of the midsole 200. In this embodiment, transmission efficiency of a load from the foot of the wearer to the plate 300 is increased, and the force of the foot is effectively transmitted to the ground.

It is to be understood by those skilled in the art that the plurality of exemplary embodiments described above are specific examples of the following aspects.

A sole 10 according to one aspect of this disclosure is a sole constituting a part of footwear, the sole including an outer sole 100, a midsole 200 disposed on the outer sole, and a plate 300 disposed at the midsole, the plate being higher in rigidity than the midsole, the plate 300 includes a toe section 310 disposed at a position overlapping a toe portion of a wearer in a thickness direction of the sole, and a midfoot section 320 having a shape that extends rearward from the toe section in a longitudinal direction of the footwear, the midfoot section being disposed at a position overlapping, in the thickness direction, a midfoot portion located at a center of a foot of the wearer in the longitudinal direction, and the toe section 310 includes a fore edge part 310*a* disposed at a position overlapping, in the thickness direction, a first distal phalanx and a second distal phalanx of the wearer or at a position located forward of the position in the longitudinal direction and having a shape that is convex-curved forward in the longitudinal direction, a recessed edge part 310*b* having a shape that extends rearward in the longitudinal direction while extending from a lateral end of the fore edge part in a width direction of the footwear toward a lateral side in the width direction and convex-curved toward a medial side in the width direction, and a lateral edge part 310*d* that has a shape extending rearward in the longitudinal direction from a lateral end of the recessed edge part in the width direction and convex-curved toward the lateral side in the width direction.

In this sole, the fore edge part of the toe section (a portion overlapping the toes located forward of MP joints of the wearer) is disposed at a position overlapping a first distal phalanx and a second distal phalanx or at a position located forward of the position, so that a first proximal phalanx and a second proximal phalanx are effectively supported by the toe section, and a load upon landing is appropriately guided in a first toe direction. Furthermore, on the lateral side of the fore edge part in the width direction, the recessed edge part having a shape that extends rearward in the longitudinal direction while extending toward the lateral side in the width direction and is convex-curved toward the medial side in the width direction is formed, so that a fourth middle phalanx and a fifth middle phalanx are prevented from overlapping the toe section. This configuration prevents movement of each joint of the third toe to the fifth toe upon take-off since movement is restricted by the plate. This in turn enables a natural takeoff and the force of the toes to be effectively transmitted to the ground upon take-off.

Further, the recessed edge part 310*b* is preferably larger in radius of curvature than of the fore edge part 310*a*. This configuration prevents, with higher reliability, the fourth middle phalanx and the fifth middle phalanx of the wearer from overlapping the toe section.

Further, the midfoot section 320 can include a rear edge part 320*a* disposed at a rear end of the midfoot section in the longitudinal direction, and the rear edge part 320*a* can be disposed at a position overlapping, in the thickness direction, a center portion of a first metatarsal, a center portion of a second metatarsal, a center portion of a third metatarsal, a center portion of a fourth metatarsal, and a center portion of a fifth metatarsal of the wearer.

Alternatively, the rear edge part 320*a* can be disposed at a position overlapping a third cuneiform bone of the wearer in the thickness direction or at a position located rearward of the position in the longitudinal direction and has a shape that is convex-curved rearward in the longitudinal direction.

Further, the midfoot section 320 can include a lateral connecting edge part 320*c* connecting the rear end edge part and the lateral edge part 310*d* of the toe section, the lateral connecting edge part 320*c* can include a first lateral connecting edge part 320*c*1 extending rearward in the longitudinal direction from the lateral edge part of the toe section and is convex-curved toward the lateral side in the width direction, and a second lateral connecting edge part 320*c*2 connecting a rear end of the first lateral connecting edge part in the longitudinal direction and the rear edge part. In this embodiment, it is preferable that the second lateral connecting edge part 320*c*2 have a shape gradually extending toward the medial side in the width direction while extending rearward in the longitudinal direction, and that a boundary between the first lateral connecting edge part 320*c*1 and the second lateral connecting edge part 320*c*2 have a shape that is convex-curved toward the lateral side in the width direction and is smaller in radius of curvature than the first lateral connecting edge part 320*cl*.

Further, the plate 300 can further include a rearfoot section 330 having a shape that extends rearward from the midfoot section in the longitudinal direction of the footwear and is disposed at a position overlapping, in the thickness direction, a rearfoot portion located at a rear of the foot of the wearer in the longitudinal direction, the rearfoot section 330 can have a rear edge part 330*a* disposed at a rear end of the rearfoot section in the longitudinal direction, and the rear edge part 330*a* can be disposed at a position overlapping a talus and a calcaneus of the wearer in the thickness direction and have a shape that is convex-curved rearward in the longitudinal direction.

Further, the plate 300 can include a low rigidity part 302, and a high rigidity part 304 higher in rigidity than the low rigidity part, the low rigidity part 302 can include a plurality of low rigidity elements 302*a* disposed at positions spaced apart from each other in the toe section and the midfoot section, and the high rigidity part 304 can be formed of a portion of the plate other than the low rigidity part.

This aspect achieves both effective support of the foot of the wearer and enhancement of movement of the toes of the wearer.

Alternatively, the plate 300 can include a low rigidity part 302, and a high rigidity part 304 higher in rigidity than the low rigidity part, the low rigidity part 302 can be disposed at a position overlapping, in the thickness direction, a third metatarsal of the wearer in the midfoot section, the high rigidity part 304 can be formed of a portion of the plate other than the low rigidity part, and a rear edge of the low rigidity part 302 in the longitudinal direction can constitute a part of the rear edge part 320*a*.

This aspect also achieves both effective support of the foot of the wearer and enhancement of movement of the toes of the wearer.

Further, the plate 300 can include a low rigidity part 302, and a high rigidity part 304 higher in rigidity than the low rigidity part, the low rigidity part 302 can be disposed at a position overlapping, in the thickness direction, a third metatarsal in the midfoot section, and the high rigidity part 304 can have a shape surrounding an entire perimeter of the low rigidity part.

This aspect also achieves both effective support of the foot of the wearer and enhancement of movement of the toes of the wearer.

Further, the plate 300 can include a low rigidity part 302, and a high rigidity part 304 higher in rigidity than the low rigidity part, the low rigidity part 302 can have a shape that includes a lateral edge of the plate in the width direction and extends in the longitudinal direction, and the high rigidity part 304 can have a shape that includes a medial edge of the plate in the width direction and extends in the longitudinal direction.

This aspect prevents, with higher reliability, the movement of each joint of the third toe to the fifth toe of the wearer since they are restricted by the plate.

Further, the midsole 200 can include a lower midsole 210 disposed between the plate and the outer sole, and an upper midsole 220 disposed on the plate. This aspect cushions impact upon landing.

In this embodiment, the lower midsole 210 is preferably lower in rigidity than the upper midsole 220. This configuration causes the lower midsole to be effectively compressed and deformed upon take-off, so that the contact area upon take-off is larger. Therefore, the force of the toes of the wearer is stably transmitted to the ground.

Further, the fore edge part 310*a* can be disposed on a surface of the upper midsole 220. This aspect makes warpage of the plate similar to the shape of toe spring at the toes, so that the transition from landing to takeoff is accelerated.

Further, a rear of the midfoot section 320 in the longitudinal direction can be disposed so as to be in contact with an upper surface of the outer sole 100. This configuration makes the warpage of the plate larger, so that the transition from landing to takeoff is accelerated.

Further, the plate 300 can be disposed entirely in contact with a back surface of the midsole 200. This aspect makes a distance between the surface of the midsole and the plate large, so as to cushion an impact applied to the forefoot portion of the footwear.

Alternatively, the plate 300 can be disposed on a surface of the midsole 200. This aspect makes a distance between the sole of the wearer and the plate small, so that transmission efficiency of a load from the foot of the wearer to the plate increases.

Further, a ratio of a thickness of the plate 300 to a thickness of the midsole 200 is preferably greater than or equal to 5% and less than or equal to 30%. Accordingly, high rigidity of the plate and weight reduction of the plate are both achieved.

Further, footwear 1 according to one aspect of this disclosure includes the sole 10 and an upper portion 20 connected to the sole and located on the sole.

The invention claimed is:

1. A sole constituting a part of footwear, the sole comprising:

an outer sole having a front side and a rear side;

a midsole disposed on the outer sole, the midsole including a lower midsole and an upper midsole, the lower midsole being lower in rigidity than the upper midsole; and a plate disposed at the midsole, the plate being higher in rigidity than the midsole, the plate located between the lower midsole and the upper midsole, the plate and the lower midsole located within a cavity in the upper midsole, the plate including a toe section disposed at a position to overlap a toe portion of a wearer in a thickness direction of the sole, and a midfoot section having a shape extending rearward from the toe section in a longitudinal direction of the footwear, the midfoot section being disposed at a position overlapping, in the thickness direction, a midfoot portion located at a center of a foot of the wearer in the longitudinal direction, the toe section including a fore edge part disposed at a position to overlap, in the thickness direction, a first distal phalanx and a second distal phalanx of the wearer and having a forward convex-curved shape in the longitudinal direction, a recessed edge part having a shape extending rearward in the longitudinal direction while extending from a lateral end of the fore edge part in a width direction of the footwear toward a lateral side in the width direction and convex-curved toward a medial side in the width direction, and a lateral edge part having a shape extending rearward in the longitudinal direction from a lateral end of the recessed edge part in the width direction and convex-curved toward the lateral side in the width direction, and the midfoot section including a medial connecting edge part extending rearward from the toe section in the longitudinal direction along the medial side, a lateral connecting edge part extending rearward from the toe section in the longitudinal direction along the lateral side, and a rear edge part having a rear edge extending from the medial connecting edge part to the lateral connecting edge part so as to cross a center portion of a first metatarsal, a center portion of a second metatarsal, a center portion of a third metatarsal, a center portion of a fourth metatarsal, and a center portion of a fifth metatarsal of the wearer in the thickness direction.

2. The sole according to claim 1, wherein the recessed edge part is larger in radius of curvature than the fore edge part.

3. The sole according to claim 1, wherein the plate includes a low rigidity part, and a high rigidity part that is higher in rigidity than the low rigidity part, the low rigidity part includes a plurality of low rigidity elements formed at positions spaced apart from each other in the toe section and the midfoot section, and the high rigidity part is formed of a portion of the plate other than the low rigidity part.

4. The sole according to claim 1, wherein the plate includes a low rigidity part, and a high rigidity part that is higher in rigidity than the low rigidity part, the low rigidity part is formed at a position to overlap, in the thickness direction, the third metatarsal of the wearer in the midfoot section, the high rigidity part is formed of a portion of the plate other than the low rigidity part, and a rear edge of the low rigidity part in the longitudinal direction constitutes a part of the rear edge part.

5. The sole according to claim 1, wherein the plate includes a low rigidity part, and a high rigidity part that is higher in rigidity than the low rigidity part, the low rigidity part is formed at a position to overlap, in the thickness direction, the third metatarsal in the midfoot section, and the high rigidity part has a shape surrounding an entire perimeter of the low rigidity part.

6. The sole according to claim 1, wherein the plate includes a low rigidity part, and a high rigidity part that is higher in rigidity than the low rigidity part, the low rigidity part has a shape including a lateral edge of the plate in the width direction and extending in the longitudinal direction, and the high rigidity part has a shape including a medial edge of the plate in the width direction and extending in the longitudinal direction.

7. The sole according to claim 1, wherein the fore edge part is disposed on a surface of the upper midsole.

8. The sole according to claim 1, wherein the plate is disposed on a surface of the midsole.

9. The sole according to claim 1, wherein a ratio of a thickness of the plate to a thickness of the midsole is greater than or equal to 5% and less than or equal to 30%.

10. Footwear comprising:

a sole according to claim 1; and an upper portion connected to the sole and located on the sole.

* * * * *